United States Patent [19]

Berthold et al.

[11] 4,209,583

[45] Jun. 24, 1980

[54] CORROSION PREVENTATIVE FOR TWO-BATH STABILIZER BATHS

[75] Inventors: Werner Berthold, Leverkusen; Artur Botta; Anita von König, both of Krefeld; Christian Rasp, Cologne, all of Fed. Rep. of Germany

[73] Assignee: Agfa-Gevaert Aktiengesellschaft, Leverkusen, Fed. Rep. of Germany

[21] Appl. No.: 901,640

[22] Filed: May 1, 1978

[30] Foreign Application Priority Data

May 5, 1977 [DE] Fed. Rep. of Germany ..... 2720111

[51] Int. Cl.[2] ..... G03C 5/38

[52] U.S. Cl. ..... 430/418; 430/429; 430/453

[58] Field of Search ..... 96/61 R, 61 M, 109

[56] References Cited

U.S. PATENT DOCUMENTS

| | | | |
|---|---|---|---|
| 3,802,883 | 4/1974 | Ohkubo et al. | 96/61 R |
| 3,880,660 | 4/1975 | Ishihara et al. | 96/61 M |
| 3,981,731 | 9/1976 | Berthold et al. | 96/61 R |

*Primary Examiner*—Mary F. Downey

*Attorney, Agent, or Firm*—Connolly & Hutz

[57] ABSTRACT

Stabilizing baths used in rapid reproduction processes of photographic elements which comprise stabilizers, hardening additives and corrosion preventatives are improved in that certain heterocyclic compounds are incorporated in the baths. Excellent protection against corrosion is attained without a deleterious effect on the quality of the photographic material.

12 Claims, No Drawings

CORROSION PREVENTATIVE FOR TWO-BATH STABILIZER BATHS

This invention relates to a process for the stabilization of developed photographic images produced by rapid reproduction techniques. It relates more particularly to baths of this kind, hereinafter referred to as stabilizing baths, which contain stabilizers, hardening additives and a corrosion preventative.

It is known that, in high speed photographic reproduction processes using silver halide-containing materials, stabilization of the developed photographic images may be carried out by means of complex formers instead of by the classical method of fixing with sodium thiosulphate followed by washing. Stabilization processes using complex formers differ from the method of fixing with sodium thiosulphate in that the silver salts are left behind in the unexposed and undeveloped areas of the photographic material in the form of a light-insensitive reaction product of the stabilizer with the silver halides originally present.

This process has become known as the "two-bath process" because the exposed photographic material is normally first developed in an activating bath and then stabilized in a second bath as described above. The stabilizers used are mainly thiocyanates, particularly ammonium thiocyanates and alkali metal thiocyanates. To prevent the photographic material being sticky after termination of the two-bath treatment owing to the hygroscopic nature of thiocyanates and their swelling effect on the emulsion layers, hardening additives may be added to the stabilizer bath. Aluminium salts are particularly suitable for this purpose, but the bath containing them must be adjusted to a low pH because they would otherwise precipitate. The addition of hardening additives to the stabilizer bath is particularly important when the emulsion layers cannot be hardened to a high degree because of the desired photographic properties.

One disadvantage of such a composition of stabilizer bath adjusted to a low pH is the extremely corrosive action of such a bath, which could even lead to partial destruction of the apparatus employed.

It is known to use benzotriazole as described in German Auslegeschrift No. 1,154,976 and polyalkylene glycols as described in U.S. Pat. No. 3,667,951 as corrosion preventatives. However, these known corrosion preventatives do not satisfy the practical requirements.

It is an object of this invention to provide a composition for a stabilizer bath containing a stabilizer, hardening additives and a corrosion preventative, which composition reduces or substantially obviates the disadvantages of the known stabilizer bath compositions. In particular, it is an object of this invention to find a corrosion preventative for a stabilizer bath, which preventative should in no way prevent stabilization or have a deleterious effect on the quality of the photographic material which is to be stabilized, particularly on the stability of the image silver, and should provide excellent protection against corrosion.

It has been found that 5-membered or 6-membered heterocyclic compounds which may carry condensed aromatic rings, in particular a condensed benzene ring which may in turn be substituted, are particularly suitable for use as corrosion preventatives in stabilizer baths. The heterocyclic 5-membered or 6-membered compounds contain a

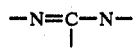

group in their 1,2,3-position and, in the 2-position, they carry an aminoalkyl group or an alkylene chain which is in addition attached to the N atom in the 1-position to form a condensed 5-membered or 7-membered ring. The substituted compounds to be used according to the invention may be used as ammonium salts after they have been reacted with acids or they may be used in the form of quaternary salts after reaction with a suitable alkylating agent.

Particularly suitable heterocyclic compounds are those corresponding to the following general formula (I) or salts of such compounds:

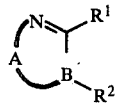

I in which $R^1$ represents a straight or branched chain alkyl group substituted with an amino group and preferably having from 1 to 11 carbon atoms, such as a methyl or ethyl group or a straight or branched chain propyl, butyl, pentyl or undecyl group. The amino group may be substituted with lower alkyl groups, preferably with alkyl groups having up to 4 carbon atoms such as methyl or propyl; or with aryl, in particular phenyl; with aralkyl, in particular phenethyl or benzyl; or with an acyl group derived from an aromatic or aliphatic short chain carboxylic acid with up to 5 carbon atoms such as acetic acid, propionic acid, butyric acid or isobutyric acid or from an aromatic carboxylic acid such as benzoic acid or toluic acid. Alkyl groups which are substituted by an amino group at the third to eighth carbon atom from the point of attachment are preferred.

$R^2$ represents hydrogen, an alkyl group with preferably 1 to 6 carbon atoms such as a methyl, isopropyl or pentyl group; a cycloalkyl group such as a cyclopentyl or cyclohexyl group; an aralkyl group such as a phenethyl or benzyl group; or an aryl group particularly a phenyl group; or $R^1$ and $R^2$ together represent an alkylene chain which may be substituted by shorter alkyl groups having up to 6 carbon atoms such as methyl, isopropyl or pentyl groups or by cycloalkyl groups such as cyclopentyl or cyclohexyl groups or by aryl groups such as phenyl groups, which alkylene chain is capable of forming a 5 to 7-membered heterocyclic ring together with the nitrogen atom in the 1-position and the carbon atom in the 2-position of the heterocyclic ring;

A represents the carbon atoms required to complete a 5-membered or 6-membered ring, such as the atoms required for completing an imidazole, imidazoline, dihydro or tetrahydropyrimidine ring, and this heterocyclic ring may also carry condensed aromatic rings, e.g. a benzo or naphtho ring, which may in turn be substituted, for example with an alkyl group having up to 6 carbon atoms such as methyl, isopropyl or t-butyl group, or with a cycloalkyl group such as cyclopentyl or cyclohexyl group, or an aralkyl group such as a benzyl group, or an aryl group such as a phenyl group or a halogen such as chlorine, e.g. benzimidazole, perimidine or dihydroquinazoline.

Compounds represented by the following general formula (II) are examples of heterocyclic compounds used in the form of a salt:

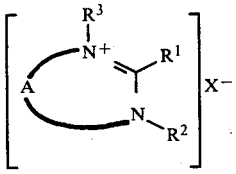

II in which $R^1$, $R^2$ and A have the meanings specified under formula (I);

$R^3$ represents a hydrogen atom or a substituent which is suitable for the formation of a quaternary salt, such as an alkyl group, particularly one with 1 to 6 carbon atoms such as a methyl, isopropyl or butyl group; or an aryl group, in particular a phenyl group; or an aralkyl group, in particular a benzyl group;

X represents a photographically inert anion required for completing a quaternary salt or an ammonium salt. It is the kind of anion conventionally used for completing quaternary salts and ammonium salts in photographic materials, such as the anions of inorganic acids, e.g. halides, in particular chlorides, nitrates or sulphates, or anions of organic acids, such as tosylate or mesylate.

Examples of heterocyclic compounds which may be used according to the invention are given below:

Table 1

In cases where the compounds of the following general formula:

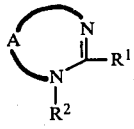

are present in the form of salts, $X^-$ denotes the anion required to form the quaternary or ammonium salt.

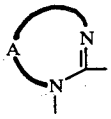

| No. | | $R^1$ | $R^2$ | $X^-$ | m.p. or b.p. |
|---|---|---|---|---|---|
| 1 | Benzimidazole | $-[CH_2]_3-NH_2$ | H | — | m.p.: 119°-120° |
| 2 | Benzimidazole | $-[CH_2]_4-NH_2$ | H | — | m.p.: 70° |
| 3 | Benzimidazole | $-[CH_2]_5-NH_2$ | H | — | m.p.: 99° |
| 4 | Benzimidazole | $-[CH_2]_{11}-NH_2$ | H | — | m.p.: 73,5°-74,5° |
| 5 | Benzimidazole | $-[CH_2]_3-NH-CH_3$ | H | — | m.p.: 137,5° |
| 6 | 5-Methylbenzimidazole | $-[CH_2]_3-NH-CH_3$ | H | — | m.p.: 126° |
| 7 | Benzimidazole | $-[CH_2]_5-NH-CH_3$ | H | — | $b.p._{0,3}$: 195°-205° |
| 8 | Benzimidazole | $-[CH_2]_5-NH_2$ | $C_6H_5$ | — | $b.p._{0,3}$: 185° |
| 9 | Benzimidazole | $-[CH_2]_5-NH-CH_2-C_6H_5$ | H | — | $b.p._{0,1}$: 239°-240° |
| 10 | Benzimidazole | $-[CH_2]_5-NH-CO-C_6H_5$ | H | — | m.p.: 201 202° |
| 11 | Benzimidazole | $-CH_2-CH_2-CH_2-CH_2-CH_2-$ | | — | m.p.: 126° |
| 12 | Benzimidazolinium | $-CH_2-CH_2-CH_2-CH_2-CH_2-$ | | $Cl^-$ | m.p. 226°-228° |
| 13 | Benzimidazole | $-CH_2-CH_2-CH_2-CH_2-$ | | — | m.p. 106° |
| 14 | Benzimidazole | $-CH_2-CH_2-CH_2-$ | | — | m.p. 114° |
| 15 | 3-Methylbenzimidazolinium | $-CH_2-CH_2-CH_2-CH_2-CH_2-$ | | Tosylate | m.p. 171° |
| 16 | 3,4,5,6-Tetrahydropyrimidine | $-[CH_2]_4-NH_2$ | H | — | $b.p._{10}$: 158° |
| 17 | 3,4,5,6-Tetrahydro-pyrimidine | $-[CH_2]_5-NH_2$ | H | — | $b.p._{0.05}$: 137° |
| 18 | 3,4,5,6-Tetrahydro-pyrimidine | $-[CH_2]_5-NH_2$ | $-[CH_2]_3-NH_2$ | — | $b.p._{0,2}$: 155°-60° |
| 19 | Pyrimidine | $-[CH_2]_5-NH_2$ | H | — | m.p.: 193° |
| 20 | 7-Chlorbenzimidazole | $-CH_2-CH_2-CH_2-CH_2-CH_2-$ | | — | m.p.: 115° |
| 21 | 4-Chlorbenzimidazole | $-CH_2-CH_2-CH_2-CH_2-CH_2-$ | | — | m.p.: 136° |
| 22 | 2-Imidazoline | $-[CH_2]_5-NH_2$ | H | — | m.p.: 78°-81° |
| 23 | 5-Methyl-2-imidazoline | $-[CH_2]_5-NH_2$ | H | — | $b.p._{0,05}$: 116°-120° |
| 24 | 2-Imidazoline | $-[CH_2]_{11}-NH_2$ | H | — | m.p.: 96-97° |
| 25 | 3,4,5,6-Tetrahydro-pyrimidine | $-CH_2-CH_2-CH_2-$ | | — | $b.p._{11}$: 97°-99° |
| 26 | 3,4,5,6-Tetrahydro-pyrimidine | $-CH_2-CH_2-CH_2-CH_2-CH_2-$ | | — | $b.p._{13}$: 130° |
| 27 | Benzimidazole | $-CH_2-C(CH_3)_2-NH_2$ | H | — | m.p.: 210° |
| 28 | Benzimidazole | $-CH_2-CH_2-CH(C_4H_9\text{-tert.})-CH_2-CH_2-NH_2$ | H | — | $b.p._{0,05}$: 215°-18° |
| 29 | Benzimidazole | $-[CH_2]_5-N(CH_3)_2$ | H | — | $b.p._{0,05}$: 197° |
| 30 | Benzimidazole | $-CH_2-CH_2-CH(C_4H_9\text{-tert.})-CH_2-CH_2-$ | | — | m.p.: 143° |
| 31 | 3,4,5,6-Tetrahydro-pyrimidine | $-[CH_2]_5-NH_2$ | $CH_3$ | — | $b.p._{15}$: 168°-170° |

Table 1-continued

In cases where the compounds of the following general formula:

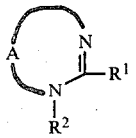

are present in the form of salts, $X^-$ denotes the anion required to form the quaternary or ammonium salt.

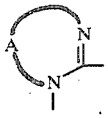

| No. | | $R^1$ | $R^2$ | $X^-$ | m.p. or b.p. |
|---|---|---|---|---|---|
| 32 | 3,4,5,6-Tetrahydro-pyrimidine | $-[CH_2]_6-NH_2$ | H | — | $b.p._{10}$: 188° |
| 33 | Imidazoline | $-[CH_2]_5-NH_2$ | $-[CH_2]_5-NH_2$ | — | $b.p._{0,1}$: 128°-30° |
| 34 | Imidazoline | $-[CH_2]_4-NH_2$ | H | — | $b.p._{12}$: 155° |
| 35 | Imidazoline | $-[CH_2]_6-NH_2$ | H | — | $b.p._{10}$: 175° |
| 36 | Imidazoline | $-CH_2-CH_2-CH_2-CH_2-$ | | — | $b.p._{0,03}$: 42-44° |
| 37 | Benzimidazolinium | $-[CH_2]_5-NH_2$ | H | $NO_3$ (Dinitrate) | m.p.: 145°-146° |

The following are also examples of suitable benzimidazole derivatives for the process according to the invention:

2-(γ-Isobutylaminobutyl)-; 2-(ε-acetylaminopentyl)-; 2-(ε-dimethylaminopentyl)-; 2-(aminohexyl)-; 2-(ω-aminoheptyl)-; 2-(γ-aminobutyl)-1-ethyl-; 1,2-(1'-methyltrimethylene)-; 1,2-(2'-ethyltrimethylene)-; 1,2-(3'-methyltrimethylene)-; 1,2-(1'-benzyltrimethylene)-; 1,2-(3'-phenyltetramethylene)-; 1,2-(3'-isopropyl-4'-methyltetramethylene)-; 1,2-(3'-t-butylpentamethylene)-; 1,2-(5'-cyclohexylpentamethylene)-benzimidazole; its 4-, 5-, 6- and 7-methyl compound; its 5-trifluoromethyl, 5-t-butyl and 5-phenyl compound; its 4,6- and 5,7-dimethyl compound; its 4-, 5-, 6- and 7-chloro and bromo compounds and its 5,6-dichlorocompound as well as benzimidazole derivatives having the substituents in the 1- and 1,2-position shown in Table 1.

The compounds used according to the invention may also be used in the form of their bases or in the form of their salts, as already mentioned above, and it is open to choice which of the nitrogen atoms of the given compound is used for salt formation.

The heterocyclic compounds used according to the invention may be prepared by known methods.

2-(ω-Aminoalkyl)-benzimidazoles, for example, may be prepared by reacting phenylene diamines with amino acids or amino acid derivatives as described in Chem. Reviews 74, 279 to 283 (1974); German Pat. No. 1,131,688 and British Pat. No. 1,023,792; with reactive lactime derivatives as described in German Offenlegungsschrift No. 2,110,227, or with lactams as described in German Offenlegungsschrift No. 2,321,054.

1,2-Alkylene-benzimidazoles can be prepared by thermal acid catalysed decomposition of 2-(ω-aminoalkyl)-benzimidazole as described in German Offenlegungsschrift No. 2,435,406; by ring opening condensation of phenylene diamines with lactones as described in Ann. 596, 209 (1955); J. Org. Chem. 24, 419 to 421 (1959) and Z. Naturforsch. 25B, 928 to 931 (1970) or by cyclising condensation of o-phenylenediamines with ω-halogen carboxylic acid imino ether hydrochlorides as described in J. Org. Chem. 27, 2165 (1962). The preparation of 1,2-alkylene-imidazolines has been described in J. prakt. Ch. [2] 140, 59 [1934] and that of 1,2-alkylene-3,4,5,6-tetrahydropyrimidines has been described in Synthesis 11, 591 [1972].

The salts of the basic compounds according to the invention with photographically inert acids are prepared by the usual methods. Quaternary salts of 1,2-alkylene benzimidazoles are prepared by quaternisation with suitable alkylating agents such as alkyl or aralkyl halides, tosylates, sulphates or mesylates.

The preparation of Compound 11 will now be described by way of example.

5 g of methanesulphonic acid are added to 200 g (1 mol) of 2-(5'-aminopentyl)-benzimidazole. The mixture is heated with stirring to 300° C. for one hour and kept at 300° to 320° C. for about 10 to 15 hours until evolution of ammonia ceases. Subsequent fractional distillation of the reaction mixture yields 159 g (85.4% of the theory) of 1,2-pentamethylene benzimidazole, $b.p._{0.05}$ 145° to 148° C. and m.p. 126° C., colourless crystals after recrystallisation from 3 parts of ethyl acetate.

It has already been disclosed that such compounds can be used as corrosion preventatives for protection against frost and particularly in heat transfer systems, in German Auslegeschrift No. 2,235,093. The solutions which contain the corrosion preventative as well as the systems which are required to be protected against corrosion in the present invention differ fundamentally from the systems described in German Auslegeschrift No. 2,235,093 in that they have a very low pH and high concentration of thiocyanate ions in the stabilizer baths. Therefore, the advantageous effect of these substances in stabilizer baths is completely unexpected.

The compounds to be used according to the invention are generally added to the stabilizer baths in a quantity of from 0.01 to 1% by weight, based on the total quantity, preferably in a quantity of from 0.05 to 0.2% by weight.

The 2-amino- and 2-methylaminoalkylbenzimidazoles are particularly preferred corrosion preventatives.

The stabilizer baths containing the corrosion preventatives used according to the invention have a pH of between 3.0 and 5.0, preferably a pH of 3.5. The stabilizer baths may be buffered to ensure a constant pH.

Suitable stabilizers which are capable of converting the silver halide left over from development into a light-insensitive compound have been described, for example, in British Pat. Nos. 631,184 and 959,807; U.S. Pat. No. 2,525,532 and French Pat. No. 1,237,454. The thiocyanates preferably used as stabilizers are normally used in quantities ranging from 10 to 40% by weight, based on the stabilizer bath. The aluminium salts used as hardeners are added in quantities ranging from 3 to 10% by weight, based on the stabilizer bath.

Stabilizer baths containing the corrosion preventatives according to the invention can be used at temperatures of up to about 30° C. and are preferably used at 20° C. They are generally used in continuous roller processing apparatus. In continuous operation, the concentrations of the components of the stabilizer bath change within certain limits due to chemical reactions with the photographic emulsions, contamination with activator bath carried in with the photographic paper and removal of stabilizer bath with the paper. These changes are to some extent compensated by replenishment of the stabilizer bath with fresh solution. The pH of the stabilizer bath is kept substantially constant by buffering. The apparatus are normally emptied, cleaned and filled with fresh baths once a week.

In addition to the corrosion preventatives used according to the invention it may, of course, be advantageous to add other substances to the stabilizer baths, for example alkali metal sulphites or alkali metal disulphites, acids such as acetic acid or citric acid and/or their salts as well as heterocyclic mercapto compounds which stabilize the silver image, e.g. 1-phenyl-5-mercaptotetrazole and 3-imino-1,2,4-triazolidine-5-thione as described in German Offenlegungsschrift No. 1,547,970 and German Offenlegungsschrift No. 1,921,740.

As the examples will show, the stabilizer baths containing the corrosion preventatives according to the invention are distinctly superior in their protection against corrosion to the stabilizer baths known in the art.

EXAMPLE 1

This example illustrates the corrosion preventive action of the substances used according to the invention in a stabilizer bath. A stabilizer bath having the composition indicated below is adjusted to pH 3.5 and made up to 1000 ml.

Stabilizer bath

Table 1

| Substance | Quantity |
|---|---|
| water | 800 ml |
| $Al(NO_3)_3 \cdot 9 H_2O$ | 100 g |
| Boric acid | 8 g |
| Sodium acetate | 50 g |
| Citric acid | 15 g |

Table 1-continued

| Substance | Quantity |
|---|---|
| Ammonium thiocyanate | 300 g |
| Sodium thiosulphate | 20 g |

To this basic composition of stabilizer bath are added corrosion preventatives and comparison reagents in the quantity indicated in Table 2.

A piece of steel (approximately 12 $cm^3$) having the following composition is introduced in each case into 50 ml of the baths indicated in Table 2.

Composition of the steel 18 to 20% chromium,
8 to 12% nickel,
2% manganese,
0.08% carbon,
the remainder iron.

The temperature of the experiment is kept constant at 20° C. Any corrosion on the steel is detected by the formation of iron thiocyanate which is measured colorimetrically in a spectral photometer at 460 nm. The extinction values obtained after subtraction of the extinction of a comparison solution (same solution without steel) are entered in columns IV and V of Table 2. This is a very reliable method of measuring corrosion because the iron thiocyanate formed by corrosion absorbs very strongly. When steel samples of a different composition are used, similar or only insignificantly different results are obtained.

Table 2

| Adsorption and extinction of the stabilizer bath | | | | |
|---|---|---|---|---|
| I | II | III | IV | V |
| | | Quantity | Corrected extinction after | |
| No. of experiment | No. of compound | of II (g/l) | 1 hour | 1 day |
| 1 | — | — | 0.46 | no longer measurable(+) |
| 2 | benzo-triazole | 1.0 | 0.47 | " |
| 3 | 25 | 1.0 | 0.01 | 0.09 |
| 4 | 27 | 1.0 | 0.02 | 0.03 |
| 5 | 4 | 0.5 | 0.025 | 0.02 |
| 6 | 7 | 0.5 | 0.025 | 0.025 |
| 7 | 7 | 1.0 | 0.02 | 0.02 |
| 8 | 11 | 1.0 | 0.015 | 0.03 |
| 9 | 14 | 0.5 | 0.01 | 0.05 |
| 10 | 15 | 1.0 | 0.015 | 0.02 |

(+)In experiments 1 and 2, the extinction could no longer be accurately measured after one day because it had become very strong by that time and solid substances had been deposited.

Visual assessment and, particularly, the extinction measurements obtained show that stabilizer baths containing the corrosion preventatives used according to the invention have a much lower extinction than a bath without corrosion preventative (experiment No. 1) and the extinction is also much lower than that of a bath containing benzotriazole as comparison substance (experiment No. 2). When assessing the individual corrosion preventatives for their effectiveness, it should be noted that the values given in Table 2 have been obtained with baths which are the same in composition with the exception of the corrosion preventative and are all at the same pH. This means that the baths have not been optimised by varying the composition of the bath or its pH to enable the individual corrosion preventatives to produce their best results. Even further improvement in the protection against corrosion is therefore still possible.

EXAMPLE 2

This example shows that the corrosion preventatives used according to the invention provide better protection against corrosion in stabilizer baths than corrosion preventatives disclosed in the art. The experimental arrangement is similar to that described in Example 1.

Table 3

| Absorption and extinction of the stabilizer bath | | | | | | |
|---|---|---|---|---|---|---|
| I | II | III | IV | V | VI | |
| No. of | | Quantity of | Corrected extinction after | | | |
| Experiment | No. of compound | II (g/l) | 1 day | 7 days | 16 days | Remarks |
| 11 | 1 | 1 | 0.02 | 0.02 | 0.035 | |
| 12 | 7 | 1 | 0.015 | 0.035 | 0.04 | |
| 13 | Polyethylene glycol 20 M++ | 2 | 0.53 | no longer measurable(+) | cloudy solution obtained | |
| 14 | Polyethylene glycol 300+++ | | 0.015 | 0.41 | no longer measurable(+) | |

(+)see Table 2
(++)Polyethylene glycol with a molecular weight of from 15,000-20,000 according to U.S. Pat. No. 3,667,951, column 6, Example 2
(+++)Polyethylene glycol with a molecular weight of 300, according to U.S. Pat.No. 3,667,951, Column 6, Example 2

We claim:

1. Aqueous stabilizer bath composition for stabilizing photographic materials containing developed silver in a silver halide emulsion, which bath composition contains a stabilizing agent selected from the group consisting of thiocyanate and thiosulfate, a hardener and a corrosion preventative, wherein the improvement comprises the corrosion preventative is a heterocyclic compound corresponding to one of the following formulae:

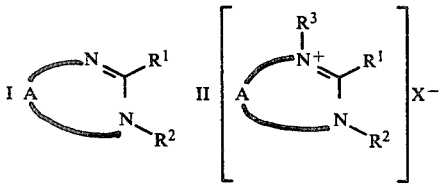

wherein $R^1$ represents a straight chain or branched chain alkyl group with 1 to 11 C atoms which is substituted with an amino group, which amino group may be substituted by short chain alkyl groups, aryl, aralkyl or acyl;

$R^2$ represents hydrogen, alkyl with 1 to 6 C atoms, cycloalkyl, aralkyl or aryl, or $R^1$ and $R^2$ represents the alkylene chain required for forming a 5-membered or 7-membered ring, which alkylene chain may be substituted by alkyl, cycloalkyl or aryl;

A represents the carbon atoms required for completing a 5-membered or 6-membered ring, which ring may carry a ring or rings condensed to the 5- or 6-membered ring;

$R^3$ represents a hydrogen atom or an alkyl, aralkyl or aryl group;

X represents a photographically inert anion.

2. Stabilizer bath composition according to claim 1, containing a thiocyanate and an aluminium compound.

3. Stabilizer bath composition according to claim 1, wherein the improvement comprises the heterocyclic compound is a compound corresponding to the following formula

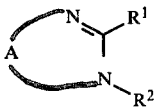

wherein $R^1$ denotes a straight chain or branched chain alkyl group with 1 to 11 C atoms which is substituted with an amino group, which amino group may be substituted by short chain alkyl groups, aryl, aralkyl or acyl;

$R^2$ represents hydrogen, alkyl with 1 to 6 C atoms, cycloalkyl, aralkyl or aryl, or $R^1$ and $R^2$ represent the alkylene chain required to form a 5- to 7-membered ring, which alkylene chain may be substituted by alkyl, cycloalkyl or aryl;

A represents the carbon atoms required for completing a 5-membered or 6-membered ring, which carbon atoms may carry condensed aromatic rings.

4. Stabilizer bath composition according to claim 1, wherein the improvement comprises $R^2$ represents hydrogen, methyl, benzyl or phenyl, and X represents chloride, nitrate, sulphate, mesylate or tosylate if $R^3$ represents hydrogen, an alkyl with 1 to 5 C atoms, phenyl or benzyl.

5. Stabilizer bath composition according to claim 1, wherein the improvement comprises $R^1$ and $R^2$ together represent a trimethylene, tetramethylene or pentamethylene group.

6. Stabilizer bath composition according to claim 1, wherein the improvement comprises A represents the atoms required for completing a substituted or unsubstituted imidazole, imidazoline, dihydro- or tetrahydropyrimidine ring.

7. Stabilizer bath composition according to claim 3, wherein the improvement comprises the heterocyclic nitrogen compound is a compound represented by the following general formula:

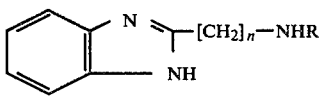

wherein

R represents a hydrogen atom or a methyl group, and n=3 to 11.

8. Stabilizer bath composition according to claim 1, wherein the heterocyclic compound is contained in it in a quantity of 0.01 to 1% by weight, based on the total quantity of the stabilizer bath composition.

9. Process for stabilizing photographic materials by image-wise exposure and processing in a bath which contains a thiocyanate, an aluminium salt, and a corrosion preventative wherein the improvement comprises the corrosion preventative is a heterocyclic 5-membered or 6-membered compound corresponding to one of the following formulae:

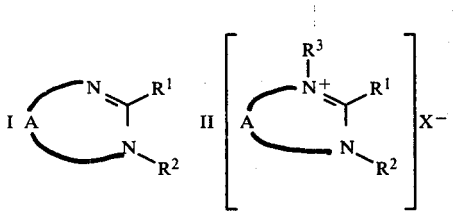

wherein $R^1$ denotes a straight chain or branched chain alkyl group with 1 to 11 C atoms substituted by an amino group, which amino group may in turn be substituted by short chain alkyl groups, aryl, aralkyl or acyl;

$R^2$ represents hydrogen, an alkyl having from 1 to 6 C atoms, cycloalkyl, aralkyl or aryl, or $R^1$ and $R^2$ represent the alkylene chain required for forming a 5- to 7-membered ring, which alkylene chain may be substituted by alkyl, cycloalkyl or aryl;

A represents the carbon atoms required for completing a 5-membered or 6-membered ring, which ring may carry a ring or rings condensed to the 5- or 6-membered ring;

$R^3$ represents a hydrogen atom or an alkyl, aralkyl or aryl group;

X represents a photographically inert anion.

10. Process according to claim 8, wherein the improvement comprises the heterocyclic compound added is a compound represented by the following general formula

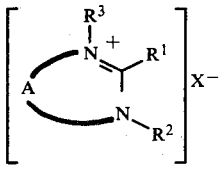

wherein $R^1$ represents a straight chain or branched chain alkyl group with 1 to 11 C atoms substituted with an amino group, which amino group may be substituted by short chain alkyl groups, aryl, aralkyl or acyl;

$R^2$ represents hydrogen, alkyl having 1 to 6 C atoms, cycloalkyl, aralkyl or aryl, or $R^1$ and $R^2$ represent the alkylene chain required for forming a 5-membered or 7-membered ring, which alkylene chain may be substituted by alkyl, cycloalkyl or aryl;

A represents the carbon atoms required for completing a 5-membered or 6-membered ring, which carbon atoms may carry condensed aromatic rings;

$R^3$ represents a hydrogen atom or an alkyl, aralkyl or aryl group;

X represents a photographically inert anion suitable for completing an ammonium or quaternary salt.

11. Process according to claim 8, wherein the improvement comprises the heterocyclic compound added is a compound represented by the following general formula:

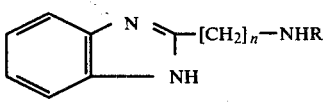

wherein

R represents a hydrogen atom or a methyl group and n=3 to 11.

12. Process according to claim 8, wherein the improvement comprises the heterocyclic compound is added in a quantity of from 0.01 to 1% by weight, based on the total quantity of the stabilizer bath.

* * * * *

UNITED STATES PATENT OFFICE

CERTIFICATE OF CORRECTION

Patent No. 4,209,583 Dated June 24, 1980

Inventor(s) Berthold et al

It is certified that error appears in the above-identified patent and that said Letters Patent are hereby corrected as shown below:

Column 2, line 9, replace "or" by --to--.

Column 2, general formula I, replace "B" by --N--.

Column 9, line 55, replace "or" by --to--.

Table 1, compound 10, should read "m.p.: 201-202°"

Table 1, compound 19, replace "Pyrimidine" by --Perimidine--.

Signed and Sealed this

*Eleventh* Day of *November 1980*

[SEAL]

*Attest:*

SIDNEY A. DIAMOND

*Attesting Officer*

*Commissioner of Patents and Trademarl*